United States Patent [19]

Micallef

[11] 4,315,582

[45] Feb. 16, 1982

[54] UNIVERSAL SEQUENTIAL DISPENSING PUMP SYSTEM FREE OF EXTERNAL CHECK VALVES AND HAVING VENTING CAPABILITY

[75] Inventor: Lewis A. Micallef, Fort Lee, N.J.

[73] Assignee: Leeds and Micallef, Fort Lee, N.J.

[21] Appl. No.: 899,268

[22] Filed: Apr. 24, 1978

[30] Foreign Application Priority Data

May 2, 1977 [GB] United Kingdom ..... 18367/77

[51] Int. Cl.[3] ..... B67D 5/42

[52] U.S. Cl. ..... 222/148; 222/321; 222/383; 417/498

[58] Field of Search ..... 222/148, 181, 185, 321, 222/340, 376, 378, 382–385, 409, 464; 239/112, 331, 333; 417/498

[56] References Cited

U.S. PATENT DOCUMENTS

| | | | |
|---|---|---|---|
| 2,283,529 | 5/1942 | Bobrick | 222/321 |
| 3,061,202 | 10/1962 | Tyler | 239/333 |
| 3,144,867 | 8/1964 | Trupp et al. | 222/321 X |
| 3,749,290 | 7/1973 | Micallef | 222/385 |
| 3,809,293 | 5/1974 | Chappell | 222/148 |
| 3,840,157 | 10/1974 | Hellenkamp | 222/385 X |
| 4,034,900 | 7/1977 | Hafele | 222/385 X |
| 4,072,252 | 2/1978 | Steyns et al. | 222/341 |
| 4,105,146 | 8/1978 | Broillard | 222/383 |
| 4,139,122 | 2/1979 | Bauer | 222/321 X |

*Primary Examiner*—Howard N. Goldberg
*Assistant Examiner*—Fred A. Silverberg
*Attorney, Agent, or Firm*—Kane, Dalsimer, Kane, Sullivan and Kurucz

[57] ABSTRACT

A pump system having two moving parts consisting of a cylinder with a piston therein defining a pump chamber. An inlet part communicates with a dip tube which extends into a container and permits the product in the container to pass into the pump chamber. An outlet port allows for the product thus drawn to be dispensed from the pump chamber. The pump is actuated by pressure directed axially on the piston, forcing it into the cylinder. Fitted with a return device the piston is allowed to reciprocate in the cylinder alternating between a suction and compression stroke. During the suction stroke product is drawn into the pump chamber by way of the inlet port while the compression stroke provides for the dispensing of the product thus drawn via the outlet port. The system is equipped with passages and channels sufficient to accomplish the operation of drawing and dispensing the product in addition to providing for the venting of the container. The suction stroke provides for air to be drawn through the outlet part from the ambient into the pump chamber, advantageously removing any residual product from the outlet part where this is desirable. In certain applications the air is drawn into the pump chamber to assist in the dispensing of the product during the compression stroke. The introduction of air into the pump chamber also assures the presence of an air pocket therein, thereby maintaining a resiliency in the system thereby preventing piston "hang up". Embodiments of the pump system are disclosed having a vertical pump axis equipped with a vertically reciprocal finger actuated button on having either a vertical or horizontal axis with a trigger actuator. Different cylinder and piston configurations are disclosed facilitating commercial applications of the system.

83 Claims, 38 Drawing Figures

FIG. 3A
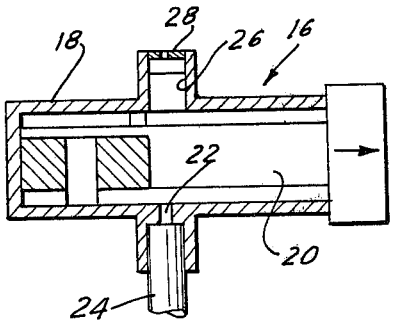
FIG. 3D
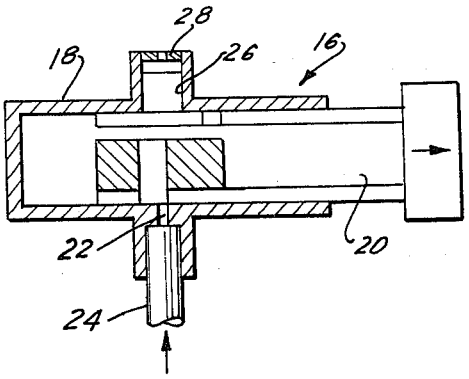
FIG. 3B
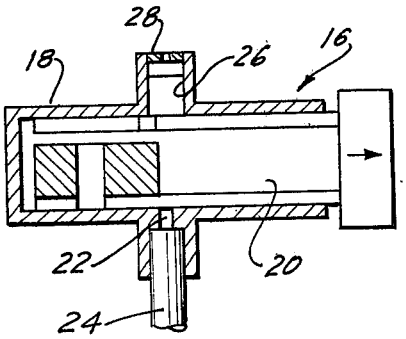
FIG. 3E
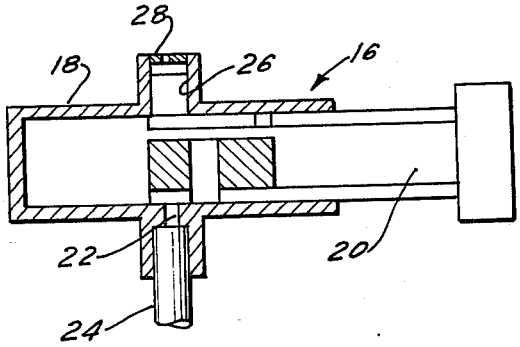
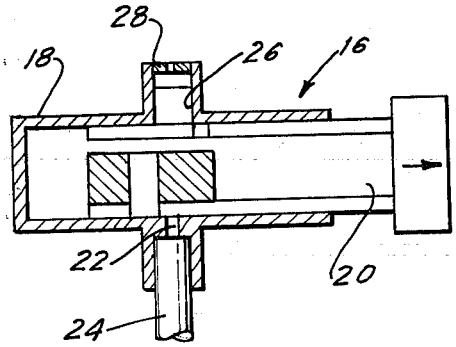
FIG. 3C FIG. 4A
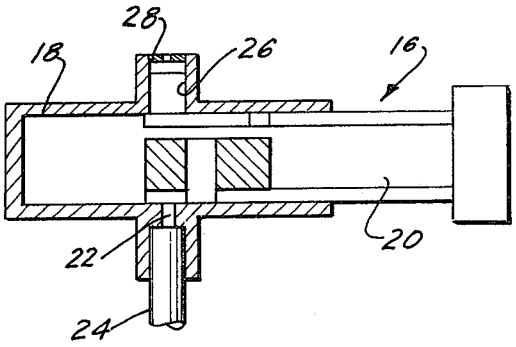
FIG. 4D
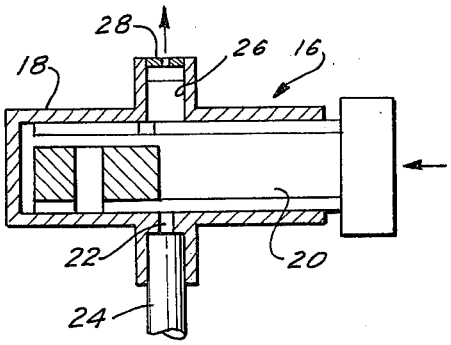
FIG. 4B
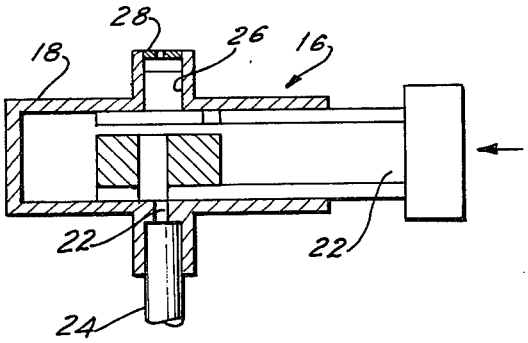
FIG. 4E
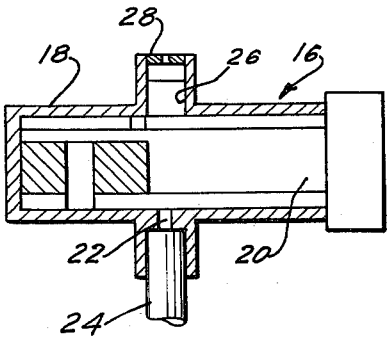
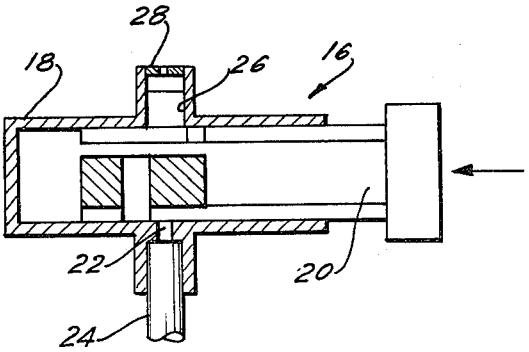
FIG. 4C FIG. 8
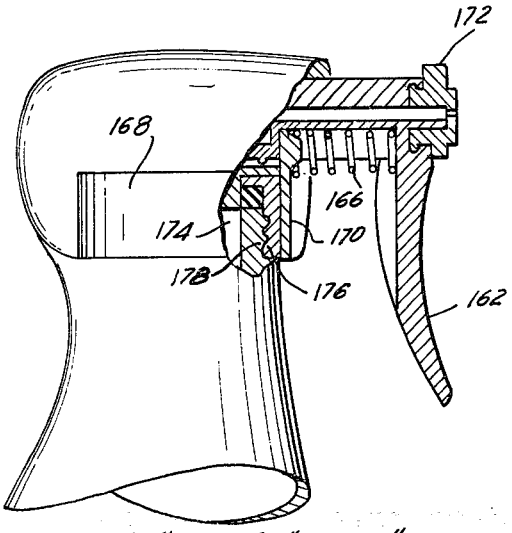
FIG. 7
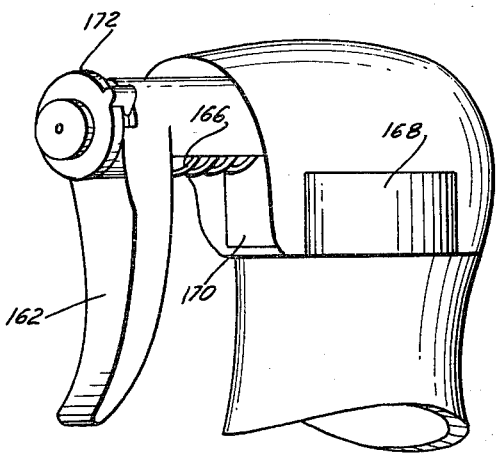
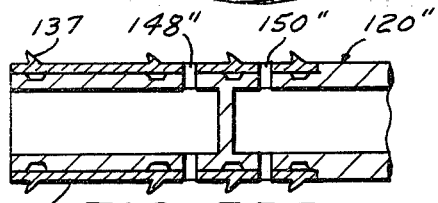
FIG. 5BB
FIG. 5D
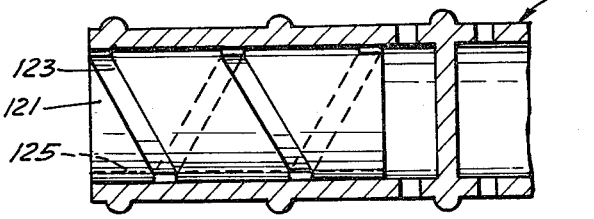
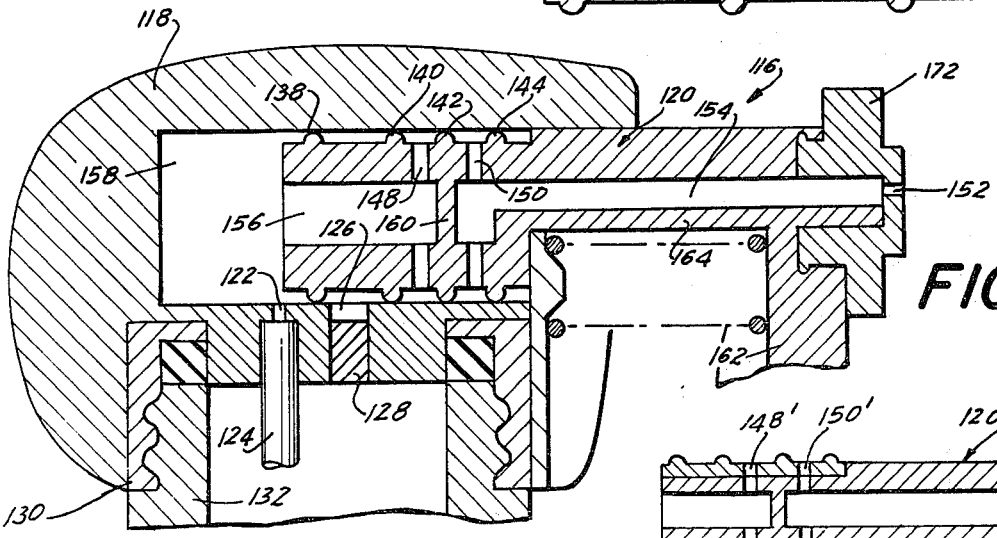
FIG. 5A
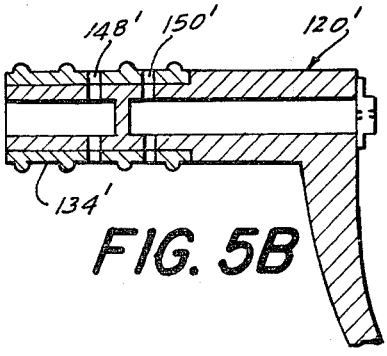
FIG. 5B
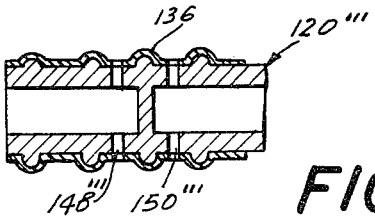
FIG. 5C

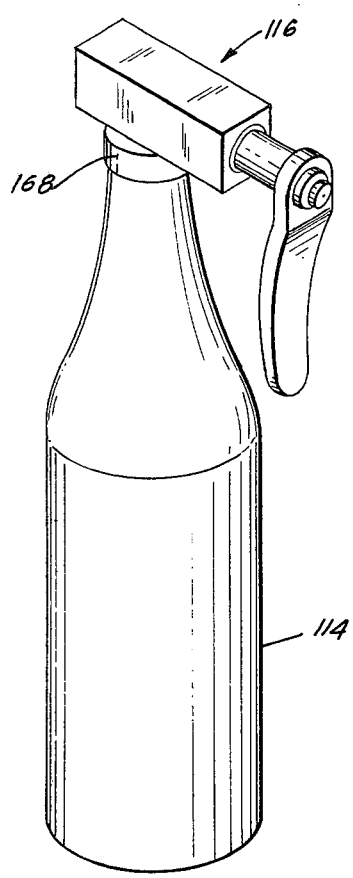
FIG. 9
FIG. 10
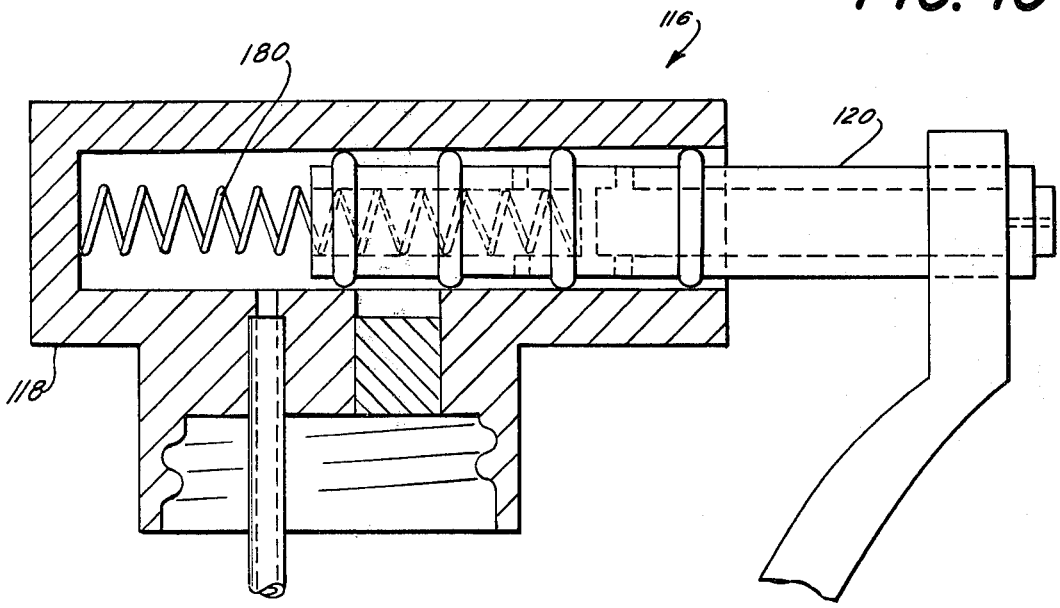

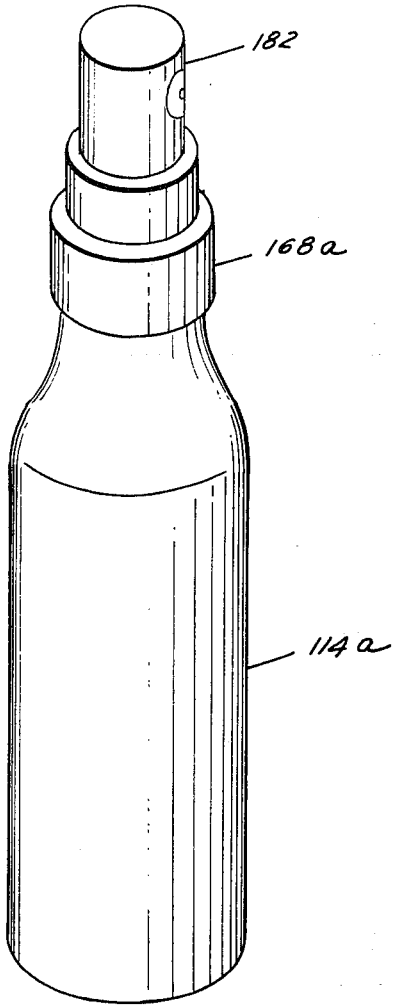
FIG. 12
FIG. 13A
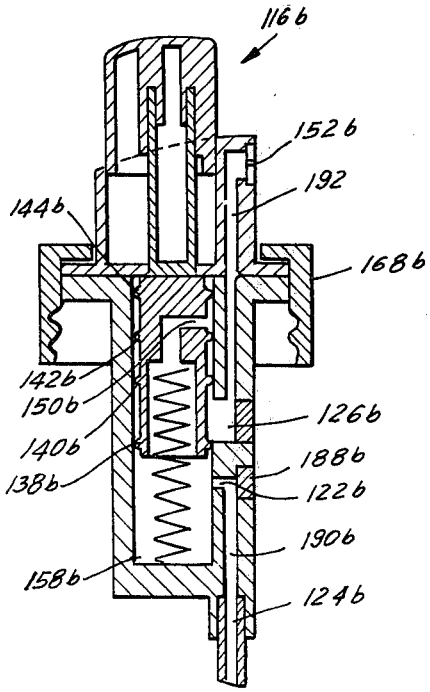
FIG. 11
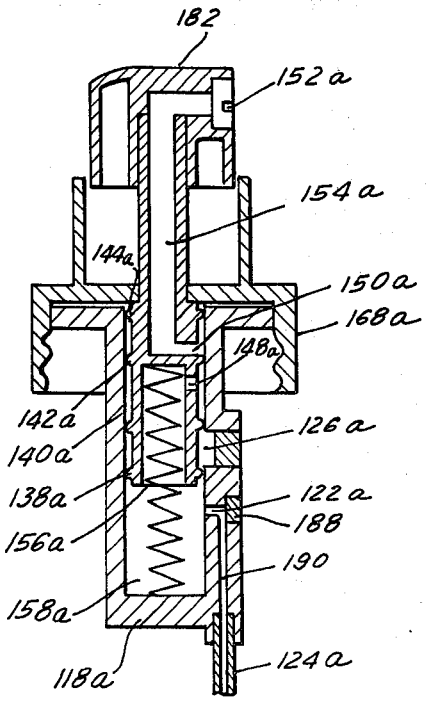

UNIVERSAL SEQUENTIAL DISPENSING PUMP SYSTEM FREE OF EXTERNAL CHECK VALVES AND HAVING VENTING CAPABILITY

BACKGROUND OF THE INVENTION

I—Field of the Invention

This invention relates to a manually operated pump for dispensing the contents of a container.

II—Description of the Prior Art

A wide variety of dispensing pumps have found commercial acceptance for dispensing a product from a container. The typical pump includes a vertically reciprocal finger actuated plunger, that causes product to pass through a dip tube, enter a pump chamber and exit through a nozzle or outlet, according to the prescribed pumping cycle and predetermined opening and closing of both inlet and outlet valves.

Similarly, trigger actuated pumps have gained in popularity with pumping being achieved by pressing and releasing a laterally disposed trigger mechanism.

However, pumps of the foregoing type require a relatively larger number of complex parts with consequent expense both in manufacture and assembly. Thus, there exists a need for dispensing pumps that are relatively simple and reliable with an absolute minimum number of parts each individually simple and inexpensive to manufacture and assemble.

The need for reliable and less costly pumps for dispensing essentially all products without limitation as to pump materials has increased; and it is becoming acute with the severe criticism of the aerosol industry and particularly aerosol dispensing packages utilizing fluorocarbon propellants with their attendant affect on the environment. In addition, such criticism has served to make the consumer aware of the inherent economy and convenience of pump type dispensers.

SUMMARY OF THE INVENTION

A principal object of this invention is to provide an improved system for manually actuating a dispensing pump which is comprised of a minimum number of parts, each individually simple to manufacture and assembly at relatively low cost; and this pump system may be constructed of essentially only two basic parts, only one of which moves, with other, mostly conventional parts, being necessary to satisfy certain applications.

Another object is to provide a piston pump based on a pump system of the foregoing type which is sealed when in the rest position for shipment, without requiring any additional parts, to further reduce costs; and, advantageously it is self-cleaning to prevent clogging of the selected nozzle or discharge orifice and thereby extremely sanitary.

A further object is to provide a system which is extremely versatile in that it may function as a vertically reciprocal pump having a laterally directed discharge orifice or a trigger pump with the pump axis being either vertically or horizontally disposed, or at any other orientation depending upon the packaging requirements.

Still another object is to provide a pump system which may be utilized without a dip tube and inverted for purposes of more convenient dispensing residual insecticides, plant sprays, foot sprays, and the like materials.

A still further object is to provide a pump system having the capability, during the dispensing cycle to compress air and entrain it with the product in order to produce a broad range of sprays from a stream to a fine suspended mist; a pump having a system of the foregoing type has the capability of large volume product delivery for relatively short piston strokes, thereby permitting shorter and less fatiguing trigger strokes by the mechanical advantage afforded by the design of the trigger mechanism.

An important object is to provide a pump system in which the air-to-product ratio during dispensing may be preset depending upon the product being dispensed and the dispensing pattern desired therefor.

Another important object is to provide a pump system of the foregoing type in which an integral built-in venting system is included as part of the pump structure and operation thereby avoiding the necessity of a separate and independent venting system for neutralizing negative pressure in the contaner head space as the product is dispensed.

BRIEF DESCRIPTION OF THE DRAWINGS

FIGS. 3A–3E are schematic representations of the pump at various stages of piston retraction during the pump chamber filling cycle;

FIGS. 4A–4E are schematic representations of the pump insertion during the pump discharge cycle;

FIG. 5A is an enlarged longitudinal sectional view of another embodiment of the pump incorporating the teachings of this invention in a manually operated trigger actuated piston pump;

FIG. 5B is a fractional view of the piston of the pump shown in 5A incorporating a ring sleeve;

FIG. 5BB is a similar view of piston with a modified sleeve having commercial application.

FIG. 5C is a fractional view of the piston of the pump shown in FIG. 5A incorporating a resilient sleeve;

FIG. 5D is a fractional view of the piston of the pump shown in FIG. 5A incorporating a grooved plug;

FIG. 7 is a perspective view of a manually operated trigger actuated piston pump incorporating the teaching of this invention and employing an external return spring shown on a container that is broken away and removed;

FIG. 8 is a side elevational view of the pump of FIG. 7 with certain parts broken away, removed and sectioned showing the external spring positioned between the tab and the trigger;

FIG. 9 is a perspective view of another embodiment of a trigger actuated pump fitted on the neck of a container for liquid to be dispensed employing an internal spring;

FIG. 10 is a longitudinal sectional view of the pump of FIG. 9;

FIG. 11 is a longitudinal sectional view of another embodiment of the pump incorporating the teachings of this invention and utilizing a standard moving orifice;

FIG. 12 is a perspective view of the embodiment shown in FIG. 11 fitted on the neck of a container for liquid to be dispensed;

FIG. 13A is a longitudinal cross-sectional view of another embodiment of the pump incorporating the teachings of this invention but utilizing a fixed orifice;

DETAILED DESCRIPTION OF THE DISCLOSED EMBODIMENTS

Figure 1:
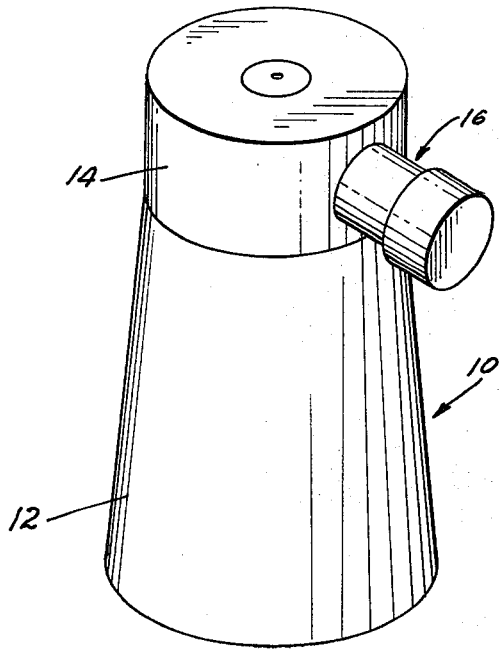
FIG. 1 is a perspective view of a cosmetic dispenser incorporating the pump shown in FIG. 2.

In reference to FIG. 1 a cosmetic dispenser package 10 is shown including a product or liquid containing bottle or container 12 and upper component retaining body or cap 14 contains the pump 16 of this invention.

Figure 2:
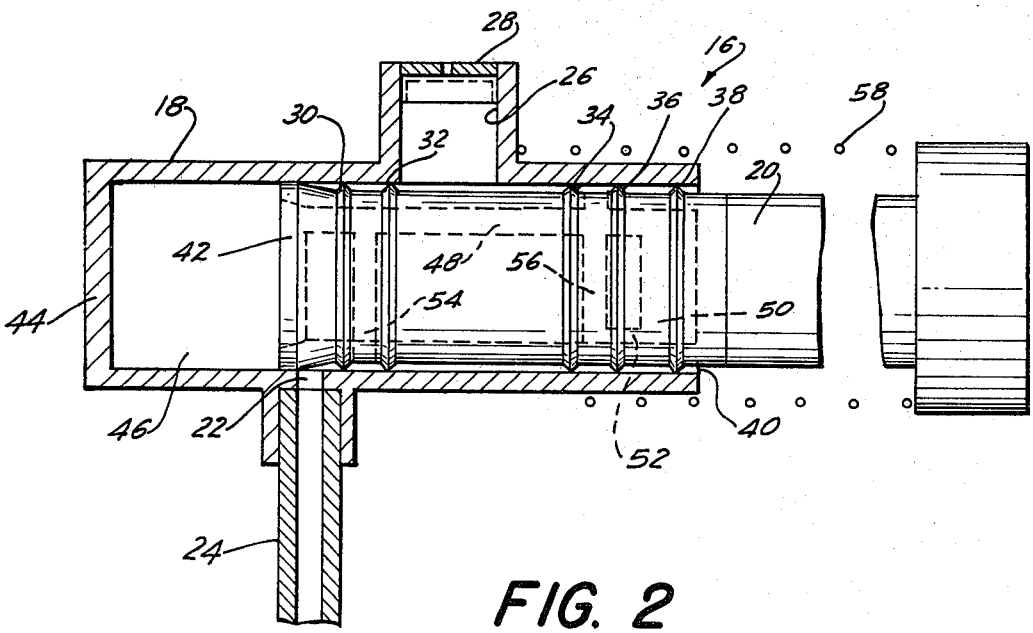
FIG. 2 is a longitudinal sectional view of an embodiment of a pump incorporating the teachings of this invention and which has an upwardly directed fixed discharge orifice normal to the pump axis.

Referring now to FIG. 2, the pump 16 includes a piston cylinder 18 and a piston 20. The cylinder 18 includes an inlet port 22 which communicates with a downwardly depending dip tube 24. In addition the cylinder 18 includes an outlet port 26 which may have coupled therewith a discharge nozzle 28 extending in an upwardly direction for convenience in cosmetic application.

A series of annular sealing or contact rings may be utilized between the piston 20 and the interior of cylinder 18. These rings may be positioned on the piston 20 or on the interior walls of the cylinder 18. In either situation, the clearance between the piston 20 and the interior walls of the cylinder 18 should be minimized to attain the maximum efficiency of the pump 16.

As depicted, rings 30 and 32 isolate the lower inlet port 22. Rings 34 and 36 isolate the upper outlet port 26. Rings 36, 38 or as many as needed prevent leakage by way of the open end 40 of the cylinder 18. The inlet and outlet ports 22 and 26, respectively, are offset which permit rings 32 and 34 to seal off the outlet port 26 in the at rest position shown in FIG. 2. During the operation of the pump 16 when ring 32 isolates the inlet port 22 from the pump chamber 46, inlet port 22 communicates with outlet port 26 to allow for venting of the container. The forward end of the piston 20 is flared outwardly in a conventional manner to press against the interior cylinder wall and also defines a piston head 42. The forward end of the piston including the piston head 42 defines with the closed end 44 of the cylinder 18 and pump chamber 46.

The piston 20 is provided with a longitudinally extending passage 48 which extends from the forward end of the piston and consequently the pump chamber 46 to a secondary trap 50 which can be varied in volume to contain and balance the mixture of air and product according to purpose. In addition, a metering channel 52 may be provided which assures the balance of mixture of air and product on the discharge stroke. The piston 20 also includes a lateral extending passage 54 from the passageway 48, which is capable of communicating with the inlet port 22. In addition, a laterally extending passage 56 extends from passageway 48 and the secondary trap 50 and is adapted to communicate with the outlet port 26. As will be appreciated from FIG. 2, lateral passageway 54 is interposed between rings 30 and 32 whereas passage 56 is interposed between rings 34 and 36.

In order to initiate the filling of the pump chamber 46, assuming initial disposition of parts as shown in FIG. 3A. The lateral passages 54 and 56 of the piston will be both sealed off from the inlet and outlet ports 22 and 26, respectively. There may or may not be an air liquid mixture in the trap 50, depending on whether or not the pump has been initially primed. The piston 20 is either manually retracted or permitted to shift to the right under the influence of an external spring 58. Eventually the lateral passageway 56 will communicate with the outlet port 26 at which time air will be drawn into the pump chamber (FIG. 3B). The lateral passageway 56 will clear the outlet port 26 and with the further movement of the piston 20 out of the cylinder 18, a vacuum or negative pressure will be generated in the pump chamber 46 (FIG. 3C). The lateral passage 54 will now communicate with the inlet port 22 at which time liquid will be drawn or sucked into the pump chamber 46 (FIG. 3D). The lateral passage 54 will then clear the inlet port 22 at which time the pump is ready to initiate its dispensing cycle.

With the pump at rest as shown in FIGS. 3 and 4A with the piston drawn to its outer limit by means of the spring 58, both the inlet and outlet ports 22 and 26 are sealed by the piston and with product and air contained in the pump chamber 46 and secondary trap 50. As the piston 18 shifts inward some product and air will be forced back down the dip tube 22. This reverse flow may be reduced or eliminated by minimizing the piston 20 clearance in the cylinder 18 or by a change in the position of the contact rings.

Then the lateral passage 54 will pass over the inlet port 22 at which time any additional equalization of pressure takes place (FIG. 4B). The inlet passage 54 will then clear the inlet port 22 at which time compression of air will take place in the pump chamber 46 and trap 50 upon further insertion of the piston 20 in the cylinder 18 (FIG. 4C). The lateral passage 56 then communicates with the outlet port 26 causing the product and air contained in the pump chamber and secondary trap to be discharged from the nozzle 28 under pressure (FIG. 4D). The lateral passage 56 is then sealed from the outlet port 26 to clip off the spray thereby ending the discharge stroke (FIG. 4E).

The pump 16 filling cycle and product dispensing cycle may then be repeated as often as desired following the foregoing sequence of steps and cycles of operation. In addition, pump 16 will remain primed after its initial priming so that repriming is unnecessary.

Referring now to a somewhat preferred embodiment of the invention as shown in FIGS. 5A and 6, the pump 116 includes a piston cylinder 118 and a piston 120. The cylinder 118 includes an inlet port 122 which communicates with a downwardly depending dip tube 124. The cylinder 118 also includes a channel 126 which is defined by a channel plug 128 and neighboring surfaces of the cylinder 118.

In order to facilitate mounting of the pump 116 on a receptacle an integral coupling means may extend from the cylinder. Towards this end, the cylinder 118 may be internally threaded as at 130 for engagement with the threaded neck 132 of a bottle or other receptacle containing the desired material to be dispensed. A separate closure cap, preferably internally threaded, having a central opening may also be used to affix the pump to the bottle or other receptacle. Obviously, other forms of connection may be employed to couple the pump to the container.

Turning now to the piston 120, contact between the piston 120 and the cylinder 118 is provided by a series of sliding dividers or annular sealing rings. These sliding dividers or sealing rings may be positioned independently on the piston 120 or may be incorporated in a ring sleeve 134 which, made of a soft material, would cover and be suitably secured to the piston 120', made of a hard material, as shown in FIG. 5B.

Of commercial importance is the embodiment of piston 120'' shown in FIG. 5BB having a molded sleeve 135 which is inexpensive to make and may be polyethylene or any suitable resinous material having compatibility with the product to be dispensed. Rings 137 are molded to extend forwardly and in the direction of compression so as to resist any tendency to collapse during the pressure stroke. Certain applications may permit the rings to extend in the rearward direction. The indicator ring configuration permits the clearance between the exterior of the sleeve between rings and the interior of the cylinder to be reduced significantly where desired or necessary. In a successful embodiment of the piston of FIG. 5BB the ring 137 was approximately 1 mm long and its forward face was inclined approximately 45° with the piston axis; and the exterior face of the rings was rounded. The base of each ring was approximately 0.6 mm wide and each ring tapers to a feather edge.

Another method of contructing the piston 120''' would be where the rings and piston are a single piece and are covered by a resilient sleeve 136 as depicted in FIG. 5C. Alternately, as will be evident to those skilled in the art and as contemplated by the invention, the contact rings may be located on the interior wall of cylinder 118 in lieu of the piston 120 with certain other modifications.

In the position of piston 120 shown, ring 138 isolates the inlet port 122. Ring 144 prevents leakage from the cylinder 118 to the exterior of the pump. Ring 140 and ring 142 isolate the piston port 148; and, similarly ring 142 and ring 144 isolate piston port 150, which is adapted to communicate with the discharge orifice or nozzle 152 through coaxial bore or channel 154.

The piston 120 is provided with a longitudinally extending coaxial bore or channel 156 which extends from the piston forward end and consequently the pump chamber 158 to the piston wall 160. The piston port 148 provides communication between the piston channel 156 and the exterior of the piston 120 between rings 140 and 142. The piston 120 also includes a second piston channel 154 which longitudinally extends from the piston wall 160 and is adapted to communicate with the outlet orifice 152. The piston port 150 provides communication between the piston channel 154 and the exterior of the piston 120 between rings 142 and 144.

In order to facilitate the mixing of air and product a means of subjecting one or both to a tortured path may be utilized. For example, one such means would be where the piston 120 is provided with a grooved plug 121, which fitted in the piston channel 156, as depicted in FIG. 5D. The plug 121 would comprise a solid core with a spiral groove 123 on its longitudinal surface, terminating at the top portion of each end of the plug and a straight groove 125 longitudinally placed across the length of the bottom portion of the plug 121. In addition, both grooves 123 and 125 would provide communication between the pump chamber 158 and the piston port 148 for the passing of product and air to be dispensed.

When the piston 120 is in its fully retracted or extended position in the cylinder 118 as shown in FIG. 5A, piston port 150 is isolated from piston port 148, thereby sealing passage or any product from the pump as specifically from pump chamber 158 and out through the orifice 152. At this disposition the unintentional dispensing of product is prevented and may be used as a shipping position if so desired, with or without a release element for maintaining this position during shipment and storage.

Figure 6A:
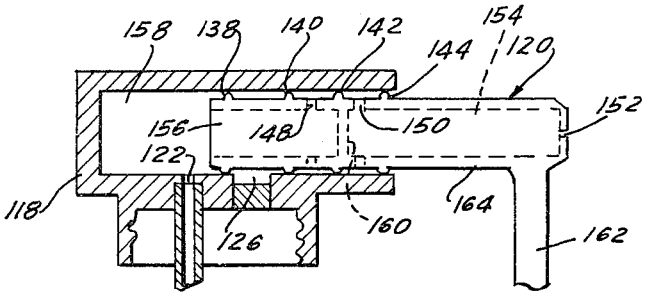
FIGS. 6A–6D are schematic representations of the pump at various stages of piston insertion during the pump discharge cycle.
Figure 6E:
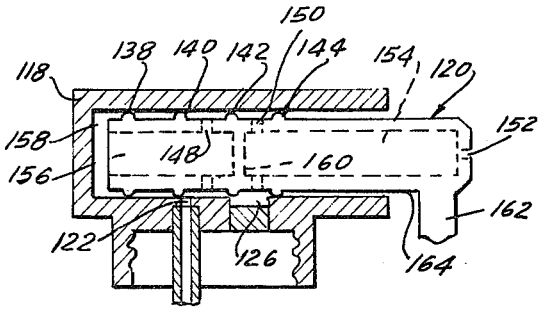
FIGS. 6E–6H are schematic representations of the pump during various stages of piston retraction during the pump chamber filling cycle.
Figure 6B:
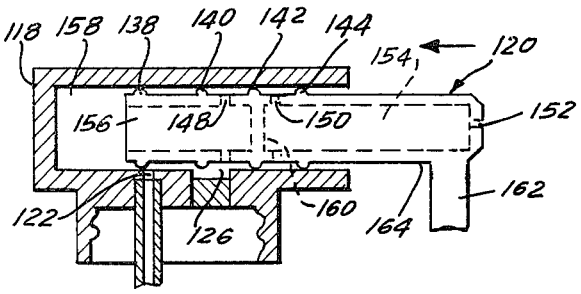

Assuming the disposition of parts as shown in FIG. 5A and as shown in FIG. 6A. Assume also that the piston 120 has completed a suction stroke and that there is product in the pump chamber 158 and piston channel 156. In certain applications depending upon the product to be dispensed and the desired spray pattern, a certain amount of air may also be present in the pump chamber 158 and channel 156, drawn in by way of the outlet orifice 152. When it is desired to dispense product and particularly the contents of the pump chamber 158 and piston channel 156, the pump 116 is activated by applying finger pressure to the trigger 162 which depends from the piston extension 164. As the piston 120 moves inwardly into the cylinder 118 to the position of FIG. 6B, some product along with some air is forced back down the dip tube 124. When desired the rings may be positioned so that this is minimized or does not occur. Once ring 138 isolates the cylinder inlet port 122 from the pump chamber 158 and ring 140 passes the cylinder channel 126 isolating piston port 148 from the cylinder inlet port 122, the passing of product down the dip tube 124 stops (FIG. 6B). Contemporaneously, ring 142 has been preventing product and air, if present, from entering the piston channel 154 from channel 156 and the pump chamber 158 by way of the piston port 150. Once, the cylinder inlet port 122 is totally isolated then upon further insertion of the piston 120 in the cylinder 118 compression or presurization of the pump chamber occurs. The distance that ring 142 travels before it reaches the cylinder channel 126 after ring 140 clears this channel determines how much compression takes place. When ring 142 enters the cylinder channel 126 the contact seal with the cylinder 118 will be interrupted causing communication between piston channel 156 and piston channel 154 by way of piston port 148 and piston port 150 (FIG. 6C). At this juncture product passes into the piston channel 154 and exits through the outlet orifice 152 and continues until ring 142 clears the channel 126. When this occurs or slightly before, the inlet port 122 is exposed to the piston port 148 allowing any remaining pressure in the piston channel 156 to dissipate back into the container through the dip tube 124. The piston port 150 is then sealed from piston port 148 by ring 142 thereby ending the discharge stroke (FIG. 6D).

Figure 6F:
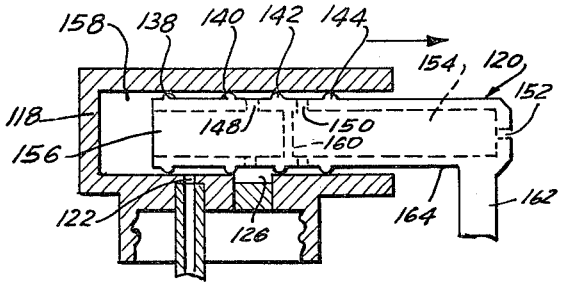
Figure 6C:
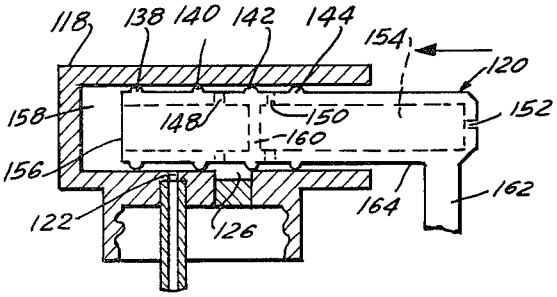

Reference is now made to the filling of pump chamber 158 and venting of the container head space as depicted in FIGS. 6E to 6H. The shifting of the piston 120 to the right, outwardly of cylinder 118 initiates the suction stroke. When ring 142 enters the cylinder channel 126 and before ring 140 reaches the cylinder inlet port 122 (see FIG. 6E) a path for air exists between the cylinder inlet port 122 and the outlet orifice 152, thereby relieving any negative pressure formed in the container, as a result of the filling of pump chamber 158 with product from the previous suction stroke, thereby venting the headspace. When ring 142 clears channel 126, piston port 148 is isolated from piston port 150 and the drawing of air stops (FIG. 6F). The air returning through the outlet orifice 152 and the piston chamber 154 and the proper selection of the size of chamber 154 clears them of product thereby preventing clogging by any residual dried out product and assuring continued optimum pump performance.

Figure 6G:
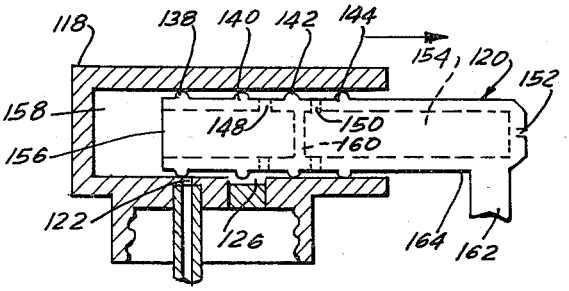
Figure 6D:
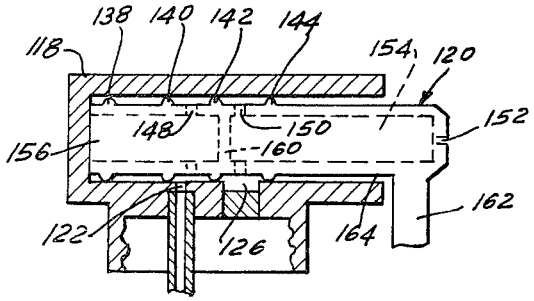
Figure 6H:
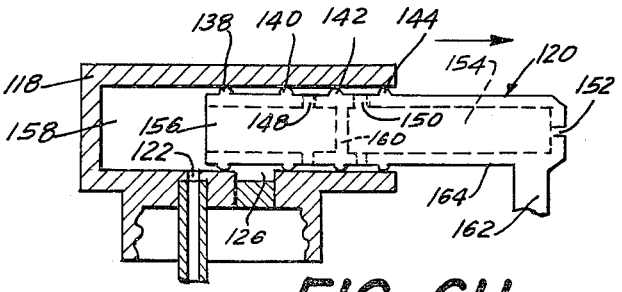

Upon further shifting outward of the piston 120 in the cylinder 118, ring 140 will pass over the cylinder channel 126 allowing communication between the cylinder inlet port 122 and piston port 148 (FIG. 6G). Now ring 138 and ring 142 cooperate in the formation of a negative pressure in the pump chamber 158 and piston channel 156 at which time liquid will be drawn or sucked into cylinder 118 from the container through the dip tube 124. When rings 140 clears channel 126, piston port 148 is sealed and isolated from pump chamber 158. Ring 138 continues to exert a negative pressure drawing product into the pump chamber 158 until the piston 120 reaches its rest position (FIG. 6H).

The pump 116 filling cycle and product dispensing cycle may then be repeated as ofen as desired following the foregoing sequence of steps and cycles of operation. Pump 116 will remain primed after initial priming.

Referring now to FIGS. 7 and 8, a proposed commercial version of the pump 116 of FIG. 5A is illustrated which may comprise an external trigger restoring spring 166, a closure cap 168, a tab 170 and a nozzle 172. Inasmuch as the spring 166 is external and does not come in contact with the product being dispensed, it need not be made of an expensive corrosion-resistant metal. The closure cap 168 has a central opening 174 and is preferably threaded internally 176 for contact with the neck of the container 178. The tab 170 conveniently serves as a retainer for the piston 120, an abutment for the external spring 170 and as a means for preventing the piston 120 and the piston extension 146 from rotating on its longitudinal axis. The nozzle 172 may assume one of many different forms. For example, it may be capable of being rotated between a closed, an open a spray and a stream position or any combination thereof.

With reference to FIG. 9, a dispenser package is shown including a container 114 and the pump 116, incorporating an internal spring 180 as shown in FIG. 10, is affixed to the container 114 in a sealed manner by way of a closure cap 168. In all other respects the structure and operation of the pump of these figures are the same as the previous embodiment and like parts will be similarly numbered.

Reference is now made to FIG. 11 which depicts an embodiment of pump of this invention with the pump axis disposed vertically to form a vertical reciprocal pump having a laterally directed discharge orifice or nozzle. In all other respects this embodiment is similar in structure, operation and construction to the embodiment of FIG. 5A and, accordingly, corresponding parts will be similarly numbered with an accompanying subscript a. Thus, the pump 116*a* is provided with a finger actuated button 182 containing a lateral outlet orifice 152*a*. This pump is affixed to a liquid container by means of a closure cap 168*a*. Pressure can be applied directly upon the button 182 to dispense the product incident to vertical reciprocation of this piston. As shown in FIGS. 11 and 12, pump 116*a* extends into the product container 114*a* to reduce the height of the overall packaging although this may not be essential in certain applications. If dispensing in an inverted manner is recommended as with foot powders and the like this may be accomplished by the elimination of the plug 188 and the channel 190 to the dip tube 124*a* as well as the dip tube itself. Corresponding modifications may be made on all embodiments of the pump.

Figure 13B:
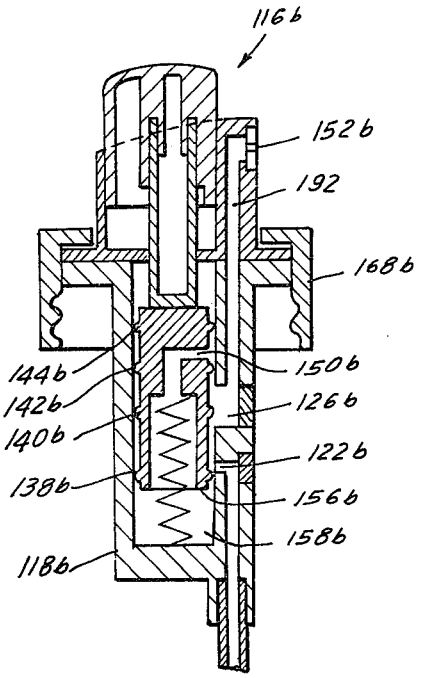
FIGS. 13B–13C are schematic representations of the pump at various stages of piston insertion and retraction.
Figure 13C:
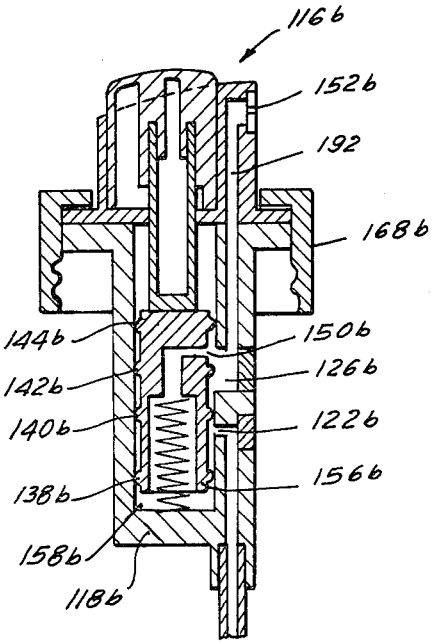

Referring now to the embodiment of the invention of FIGS. 13A–13B, it will be observed that an outlet orifice 152*b* is advantageously maintained in a fixed position and does not move when the pump is reciprocated. The cylinder 118*b* is provided with a vertical passage 192 which originates at the cylinder channel 126*b* and terminates at the outlet orifice 152*b* and an additional passage 190*b* which extends from the cylinder inlet port 122*b* and communicates with the dip tube 124*b*. The pump 116*b* is actuated by finger pressure upon the plunger 194. The piston 120*b* is provided with a piston port 150*b* located between rings 142*b* and 144*b* which allows for communication between the piston channel 156*b* and the piston 120*b* surface. Parts corresponding to previous embodiments will be similarly numbered with an accompanying subscript b. When the piston ring 138*b* isolates cylinder inlet port 122*b* from the pump chamber 158*b* and piston channel 156*b* compression of the trapped air and product begins. Eventually, ring 140*b* will be in cylinder channel 126*b* so that a path exists between the outlet orifice 152*b* and the inlet port 122*b* so that any negative pressure in the liquid container is relieved by venting. (FIG. 13B) The compression continues until ring 142*b* enters the cylinder channel 126*b* at which time ring 140*b* isolates cylinder inlet port 122*b*. Then the seal of ring 142*b* is interrupted and a path is established between the pump chamber 158*b* and piston channel 156*b* and the outlet orifice 152*b* by way of the piston port 150*b*, the cylinder channel 126*b* and the cylinder passage 192 (FIG. 13C). When this occurs, the air and product is dispensed through the outlet orifice 152*b*. On the return stroke of piston 120*b* the cylinder inlet port 122*b* is isolated from the piston port 150*b* by ring 140*b*. Then air is drawn into the pump chamber 158*b* and cylinder channel 156*b* from the outlet orifice 152*b* due to a negative pressure formed by the cooperation of rings 138*b*, 140*b* and 144*b*. (FIG. 13C) When ring 142*b* isolates piston port 150 from the cylinder channel 126*b* the drawing of air into the pump chamber 158*b* stops and the continued retraction of piston 120*b* from the cylinder 118*b* creates a vacuum in the pump chamber 158*b* and piston channel 156*b*. (FIG. 13*b*) While some air and product may be drawn about the piston surface between rings 138*b* and 142*b*, the primary operation is the creation of the vacuum in the pump chamber 158*b* and piston channel 156*b* by ring 138*b*. Once ring 138*b* passes the inlet port 122*b* product is sucked into the pump chamber 158*b* through inlet port 122*b*. The drawing of product continues until the piston 120*b* reaches its rest position. (FIG. 13A)

Figure 14:
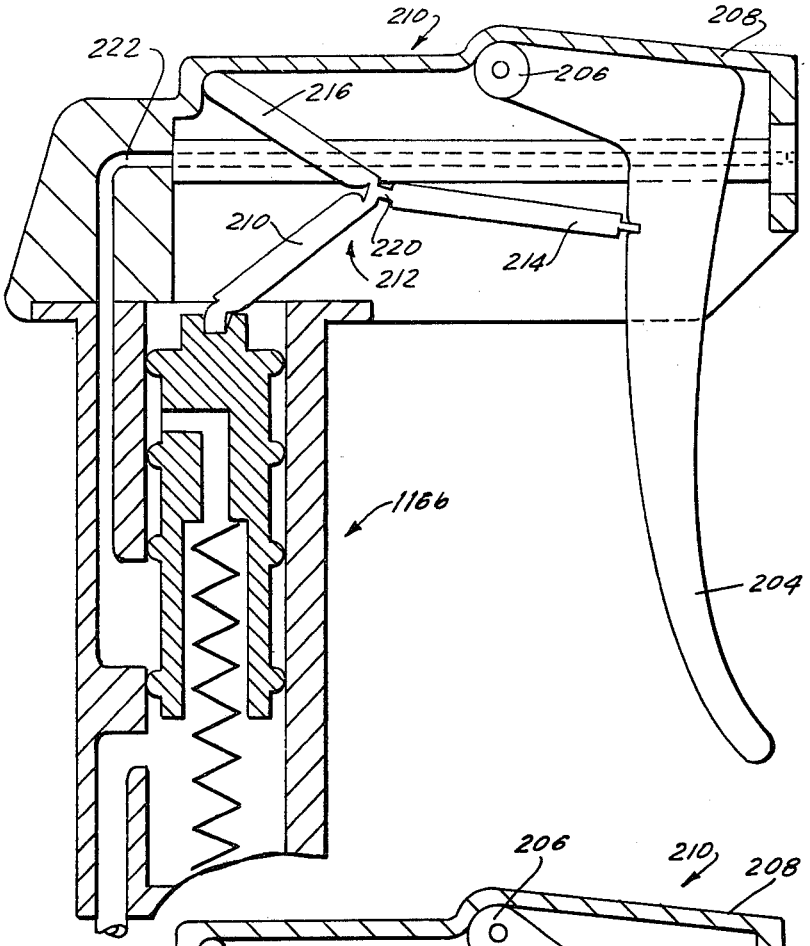
FIG. 14 is a longitudinal cross-sectional view of another embodiment of a trigger actuated pump incorporating the teachings of the invention in which the mechanical advantage is such that short piston strokes are possible for large volume product delivery.
Figure 15:
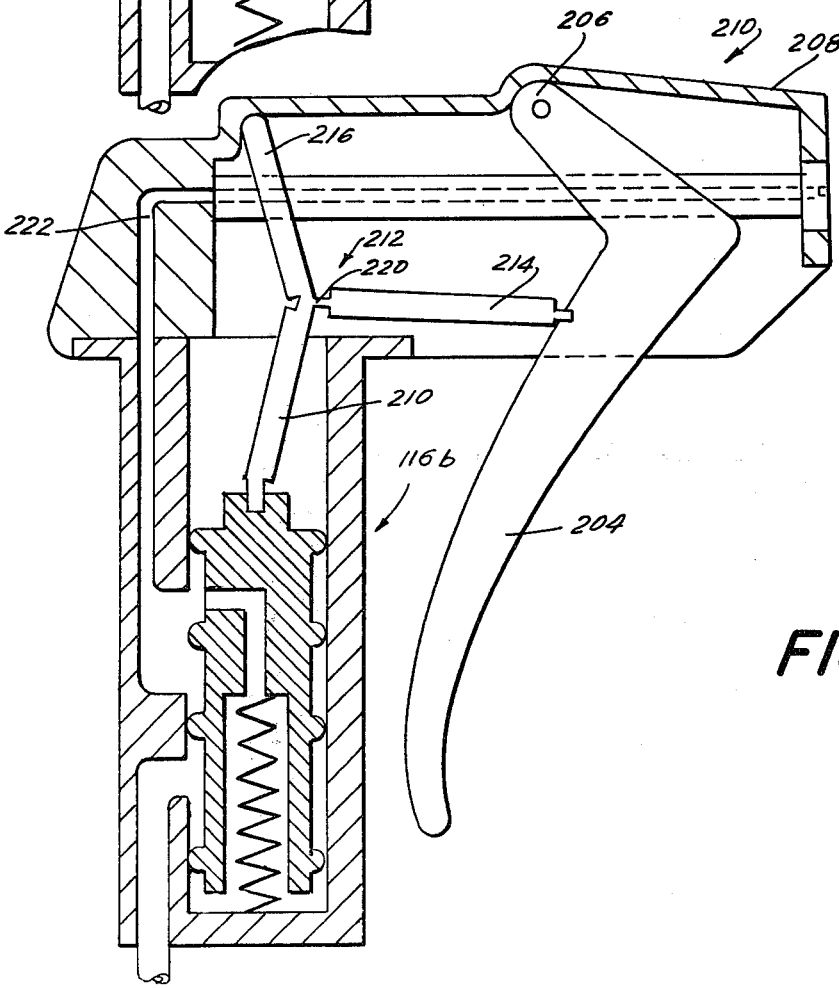
FIG. 15 is a similar view of the pump but with the trigger depressed.

Referring now to the embodiment of the pump 116*b* as shown in FIGS. 14 and 15. This is essentially the same pump as shown in FIG. 13 but in the present instance, it is actuated by means of a trigger assembly 210. FIG. 14 depicts the pump and the trigger assembly 210 in a rest or starting position. FIG. 15 shows the trigger assembly 210 in a fully contracted position with the pump dispense cycle completed. The trigger assembly 210 comprises a trigger housing 208, an actuating lever or trigger 204 which is pivotally mounted on a pivot pin 206 carried by the trigger housing 208, and a Y-shaped actuator 212. The Y-shaped actuator 212 comprises member 216, member 210 and member 214 jointly connected by a hinge 220. Member 214 engages trigger 204 while member 216 extends from the hinge 220 and pivots against the housing 208, and member 210 extends from the hinge 220 and engages the piston. A passage 222 is provided in the housing 208 to allow the passing of air and product to the outlet orifice.

Figure 16:
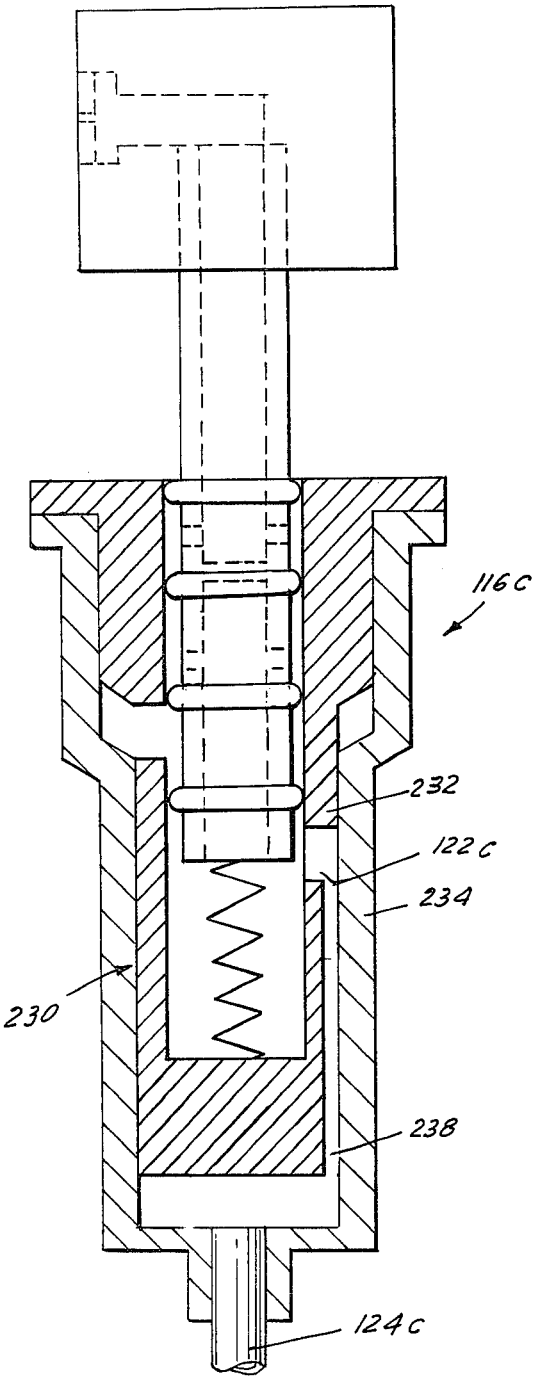
FIG. 16 is a longitudinal sectional view of another embodiment of the pump in a standard moving orifice pump employing a cylinder comprised of multiple parts and with the piston extended.
Figure 17:
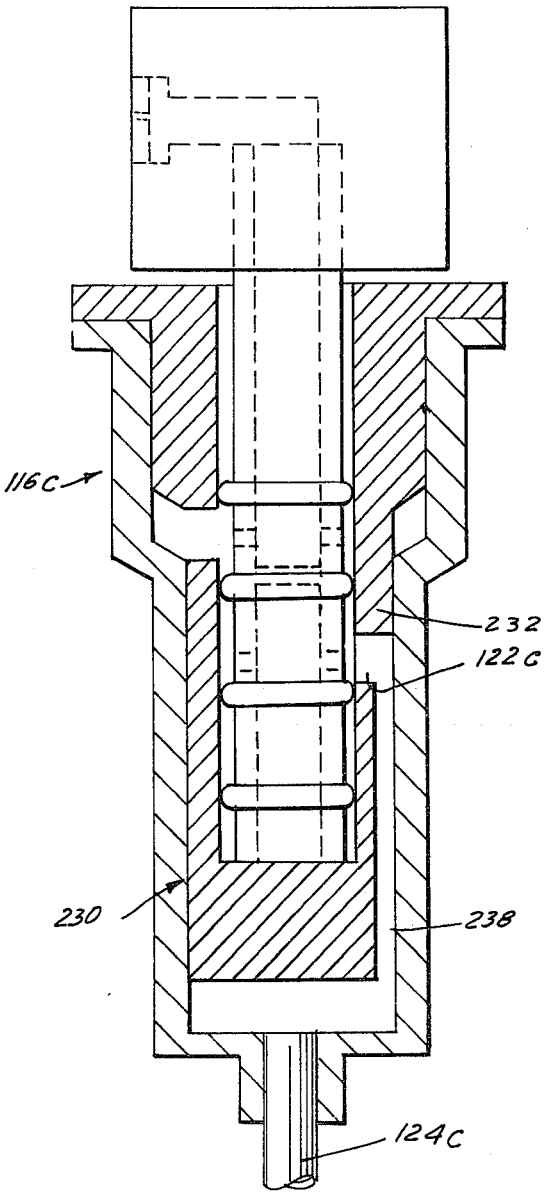
FIG. 17 is a similar view of the pump as shown in FIG. 16 but with the piston depressed.

With reference now to FIGS. 16 and 17, another embodiment of the pump is shown. FIG. 16 depicts the pump at rest whereas FIG. 17 shows the pump in a fully depressed position. Parts corresponding to the other embodiments will be similarly numbered with an accompanying subscript c. The essential difference between pump 116*c* and the preceeding embodiment of the pump 116 is the construction of the cylinder 230. The cylinder 230 may comprise a cylinder wall 232 which is surrounded by a cylinder housing 234. The cylinder channel 236 is formed by an opening in the cylinder wall 232. The cylinder inlet port 122*c* communicates with the dip tube 124*c* by way of passage 238 located between the cylinder housing 234 and the cylinder wall 232. In all other respects, construction and operation of the pump is identical to that of of the previously described vertical reciprocal pump as shown in FIG. 11.

It should be evident by all of the embodiments of the invention that the pumps construction and manufacture would remain of a simple nature in its applications. The pump is extremely versatile and can function in various positions such as horizontal, vertical or even inverted if so desired. It can be vertically reciprocal, actuated by a trigger mechanism or directly, with the discharge nozzle movable or stationary.

The diameter of the pump chamber and piston respectively may be increased in relation to the outlet port so as to be able to disperse a given large volume by a short stroke when coupled with a trigger mechanism providing an acceptable mechanical advantage.

The position of the contact rings can be adjusted to vary the ratio of air to product depending on the purpose sought to be achieved. Ring position will also govern the strength of the vacuum or negative pressure formed in the pump chamber during the filling cycle as well as the compression available for dispensing the product. As will be appreciated by those skilled in the art, piston sealing ring placement and spacing, piston and cylinder port spacing and size and cylinder channel location and size will vary depending on many factors, including avoidance of liquid lock and vapor lock, duration and amount of product dispensed with each stroke, venting and of course the desired sealing against leakage.

In the movable orifice pump, when the product exits out the orifice in the piston as in FIGS. 5–12, and 16–17, only four rings are necessary. In the fully inserted position, rings 144, 144*a* must be on the right or upper side of the channel 126, 126*a* to seal the piston. In the fully retracted position, ring 138, 138*a* must be on the right or upper side of the inlet opening 122, 122*a* to permit filling the pump chamber. The distance between ring 144 and ring 138 determines the minimum length of the cylinder. During the compression stroke when ring 138 clears the inlet opening, ring 142 should theoretically now be in the cylinder channel 126 in order to assure against liquid lock and assure proper operation of the pump. If there is sufficient resilient means in the pump chamber as disclosed herein, such as a pocket of air some compression will be permitted before this ring 142 enters the channel 126 to avoid liquid lock. Of course with proper location of ring 140, some product will be forced back into inlet opening 122, from piston port 148, channel 126 around ring 140. (See FIG. 6B) The cylinder channel 126 must be long enough to connect the piston ports 148, 150 on each side of ring 142 for a sufficient period of time to get enough product out through the outlet orifice 152. The length of channel 126 in the cylinder and the duration over which both piston ports 148, 150 are exposed to this channel determines the amount of volume of spray. Instead of lengthening the channel you may wish to locate ring 142 closer to the forward end of the piston. Therefore, to increase the volume of spray you must lengthen the channel 126 or the spacing between rings 142 and 140 to any given channel. If the spacing between rings 142 and 140 is small the time of spray will be longer, if the distance between rings 142 and 140 is lengthened the duration of spray is shortened for a fixed cylinder channel length.

With respect to the sequential pump in which the outlet orifice is fixed as in FIGS. 13–15, only three rings are necessary because ring 142*b* may be eliminated. In the fully inserted position the outermost ring 144*b* must be on the upper side of the outlet opening 126*b*. In the fully retracted position the innermost ring 138*b* must be on the upper right side of the inlet opening 122*b*. The distance between rings 138*b* and 144*b* determines the minimum length of the cylinder. During compression, when ring 138*b* clears the inlet opening 122*b* proper operation is assured and liquid lock is avoided by ring 142*b* entering the outlet opening 126*b*. A delay in the ring 142*b* entering the outlet opening 126*b* is permissible if there is sufficient air or other resilient means in the pump chamber. The placement of ring 142*b* in the fixed orifice pump cooperates in determining the amount of spray.

With the foregoing in mind, rings 36, 30 and 42 of FIG. 2 may be eliminated. The reason for rings 30 and 42 (the latter need not be present at all) is simply to retain product in the pump chamber 46 when the pump is fully retracted, otherwise there may exist the possibility of the product leaking down the dip tube 24.

It will be noted that when the ring spacing meets the requirements for effective pumping, conditions are also such that communication between the container and the atmosphere is also provided. Thus, venting of the container is an essential consequence of the pumping action. The magnitude of the pressure drop created inside the cylinder chamber before the inlet port opens is proportional to the piston travel which is equal to the distance between rings 138 and 142 minus the space between the cylinder ports including the width of the ports themselves.

As used throughout, the term "ring" is intended to cover all sealing elements the shape of which will be dependent upon the transverse cross-section of the tubular pump, whether it be circular, elliptical, straight-sided or other geometrical form. Likewise, the term cylinder is intended to embrace these cross-sectional configurations of tubes within which the piston is reciprocal.

The invention contemplates the providing of a pocket of air in the pump chamber so that the likelihood of a piston "hang-up" or a "liquid lock" is eliminated. As will be appreciated by those skilled in the field, the pump chamber can easily accommodate a flexible sponge which would similarly remedy a "hang-up" if necessary. Also, the cylinder itself may be provided with a resilient cylinder wall or portion thereof or even a controlled leakage past the rings would provide alternate solutions to the problem. The holes in the piston as well as the holes in the cylinder need not be holes as such, but could be slots or a combination of both.

Overall, the invention is easily adaptable to the varied necessities and applications of the commercial and private users and to which the embodiments shown reflect a mere portion of its ultimate utilization.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A dispensing pump system for dispensing product from a container, the pump serving as a container closure, comprising:

an outer part;

an inner part in the outer part defining a pump chamber therewith, and the parts being relatively reciprocal through a compression stroke from an extended position to an inserted position and through a suction stroke from the inserted position to the extended position;

inlet port means for cooperating in communicating the container interior with the pump chamber during the suction stroke to permit product to enter into the pump chamber from the container interior solely by creating a negative pressure differential between the pump chamber relative to the container interior to cause product to be sucked into the pump chamber;

outlet port means for product to be dispensed under pressure from the pump chamber during the compression stroke;

venting means for replacing product removed from the container interior into the pump chamber with air;

and the inner and outer part defining cooperating surfaces for sequentially opening and closing the inlet and outlet port means during the relative reciprocation of the parts during the pumping cycle to permit product to enter the pump chamber and dispense it from the pump chamber without the necessity of external inlet and outlet check valves.

2. The invention in accordance with claim 1, wherein the outer part is a cylinder and the inner part is a piston.

3. The invention in accordance with claim 2, wherein the cylinder and piston therein each have a vertically disposed axis.

4. The invention in accordance with claim 2, wherein the cylinder and piston therein each have a horizontally disposed axis.

5. The invention in accordance with claim 2, wherein the outlet port means is a discharge orifice mounted on the cylinder.

6. The invention in accordance with claim 2, wherein the outlet port means is a discharge orifice mounted on the piston.

7. The invention in accordance with claim 2, wherein the cylinder and piston therein each have a vertically disposed axis, a finger engaging button on the exterior of the piston for facilitating vertical reciprocation of the piston in the cylinder and consequently discharge of the product from the pump chamber out through the outlet port means.

8. The invention in accordance with claim 2, wherein the dispensing pump includes a trigger means coupled with the piston for actuating the piston and causing its reciprocation in the cylinder during the compression stroke and suction stroke.

9. The invention in accordance with claim 8, wherein the cylinder and piston therein have vertically disposed axes.

10. The invention in accordance with claim 8, wherein the cylinder and piston disposed therein have horizontally disposed axes.

11. The invention in accordance with claim 2, wherein cooperating passages are between the cylinder and piston to permit the product in the pump chamber to be directed out through the outlet port means during the compression stroke.

12. The invention in accordance with claim 2, wherein the venting means includes cooperating passages between the cylinder and piston to permit air to be directed from the outlet port means into the container interior.

13. The invention in accordance with claim 2, wherein the cylinder is composed of two parts with one cylinder part telescoped within the other.

14. The invention in accordance with claim 2, wherein sealing rings are on the piston and spaced from one another in a predetermined manner and in relation to the inlet port means and the outlet port means.

15. The invention in accordance with claim 2, wherein a return spring means biases the piston and the cylinder to their extended position.

16. The invention in accordance with claim 15, wherein the return spring means is within the cylinder and interposed between the piston and cylinder.

17. The invention in accordance with claim 15, wherein the return spring is externally of the cylinder and interposed between parts projecting from the piston and cylinder.

18. The invention in accordance with claim 2, wherein the cylinder has a port forming part of the inlet port means communicating with the container interior and wherein the piston is hollow and includes at least one port forming part of the inlet port means in the lateral walls thereof extending the exterior to the interior of the piston, and during the suction stroke the piston port being adapted to communicate with the cylinder port in passing the product into the pump chamber and thereafter the product is adapted to pass directly into the pump chamber from the cylinder port.

19. The invention in accordance with claim 2, wherein the dispensing pump system includes a trigger means coupled with a piston for actuating the piston and causing its reciprocation in the cylinder during the compression stroke and suction stroke, the trigger means including a force multiplying means which provides a mechanical advantage thereby permitting the piston to adapt a short stroke for a relatively large given product delivery.

20. The invention in accordance with claim 19, wherein the force multiplying means includes a lever actuated linkage assembly for transforming movement of the trigger means into lateral movement of the piston.

21. The invention in accordance with claim 2, wherein the cylinder and piston therein each have a vertically disposed axis, a finger engaging button on the exterior of the piston for facilitating vertical reciprocation of the piston in the cylinder and consequently discharge of the product from the pump chamber out through the outlet port means, the outlet port means including a discharge orifice fixedly mounted in relation to the vertical reciprocation of the piston in the cylinder, and the outlet port means including a passage network from the pump chamber to the discharge orifice for passing product from the pump chamber to the discharge orifice during the compression stroke.

22. The invention in accordance with claim 2, wherein the pump chamber includes a resilient means for acting to prevent piston hang-up in the cylinder during the pumping cycle.

23. The invention in accordance with claim 22, wherein the resilient means includes means for providing an air pocket in the pump chamber which is adapted to be compressed for purposes of eliminating piston hang-up in the cylinder.

24. The invention in accordance with claim 2, wherein the piston and the cylinder providing cooperating surfaces for sealing the outlet port means from the pump chamber and inlet port means when the piston and cylinder are in the extended position.

25. The invention in accordance with claim 1, wherein the inlet port means includes a dip tube for directing product from the container interior into the pump chamber.

26. The invention in accordance with claim 1, wherein during the suction stroke air is sucked through the outlet port means from the ambient into the pump chamber to purge product from the outlet port means thereby rendering the pump system self-cleaning during each pump cycle to prevent clogging of product in the outlet port means.

27. The invention in accordance with claim 1, wherein the vent means includes cooperating passages that permit air to be directed from the outlet port means into the container interior during the suction stroke and compression stroke.

28. The invention in accordance with claim 1, wherein a return spring means biases the piston in the cylinder to its extended position.

29. The invention in accordance with claim 28, wherein the return spring means is within the cylinder and interposed between the piston and cylinder.

30. The invention in accordance with claim 28, wherein the return spring is externally of the cylinder and interposed between parts projecting from the piston and cylinder.

31. A dispensing pump system for dispensing product from a container comprising:

a cylinder defining an outer part;

a piston defining an inner part in the cylinder and defining a pump chamber therewith, and the piston and cylinder being relatively reciprocal through a compression stroke from an extended position to an inserted position and through a suction stroke from the inserted position to the extended position;

inlet port means in the cylinder for cooperating in communicating the container interior with the pump chamber during the suction stroke to permit product to enter into the pump chamber from the container interior by creating a negative pressure differential between the pump chamber relative to the container interior to cause product to be sucked into the pump chamber;

a separate outlet port means in one of the parts for product to be dispensed under pressure from the pump chamber during the compression stroke, the inner and outer parts defining cooperating surfaces for sequentially opening and closing the inlet and outlet port means during the relative reciprocation of the parts whereupon the inner part traverses the inlet port means during the pumping cycle to permit product to enter the pump chamber and dispense it from the pump chamber;

the dispensing pump system being so constructed and arranged that during the suction stroke air is sucked through the outlet port means from the ambient into the pump chamber by creating a negative pressure differential between the outlet port means and the pump chamber during part of the suction stroke to purge product from the outlet port means thereby rendering the pump system self-cleaning during each pump cycle to prevent clogging of product in the outlet port means; and venting means provided by cooperating surfaces of the piston and cylinder for replacing product removed from the container interior into the pump chamber with air.

32. A dispensing pump system for dispensing product from a container comprising:

a cylinder defining an outer part;

a piston defining an inner part and defining a pump chamber therewith, and the piston and cylinder being relatively reciprocal through a compression stroke from an extended position to an inserted position and through a suction stroke from the inserted position to the extended position;

inlet port means in the cylinder for cooperating in communicating the container interior with the pump chamber during the suction stroke to permit product to enter into the pump chamber from the container interior by creating a negative pressure differential between the pump chamber relative to the container interior to cause product to be sucked into the pump chamber;

a separate outlet port means in one of the parts for product to be dispensed under pressure from the pump chamber during the compression stroke, the inner and outer parts defining cooperating surfaces for sequentially opening and closing the inlet and outlet port means during the relative reciprocation of the parts whereupon the inner part traverses the inlet port means during the pumping cycle to permit product to enter the pump chamber and dispense it from the pump chamber;

air assist means for assuring the presence of a predetermined quantity of air in the pump chamber to assist in the dispensing of the product from the pump chamber through the outlet port means, the predetermined quantity of air being provided in the pump chamber by creating a negative pressure differential between the pump chamber and the ambient during part of the suction stroke so that air is sucked into the pump chamber from the ambient; and venting means provided by cooperating surfaces of the piston and cylinder for replacing product removed from the container interior into the pump chamber with air.

33. The cylinder having a dispensing pump system for dispensing product from a container comprising:

a cylinder defining an outer part;

a piston defining an inner part and defining a pump chamber therewith, and the piston and cylinder being relatively reciprocal through a compression stroke from an extended position to an inserted position and through a suction stroke from the inserted position to the extended position;

inlet port means in the cylinder for cooperating in communicating the container interior with the pump chamber during the suction stroke to permit product to enter into the pump chamber from the container interior by creating a negative pressure differential between the pump chamber relative to the container interior to cause product to be sucked into the pump chamber;

a separate outlet port means in one of the parts for product to be dispensed under pressure from the pump chamber during the compression stroke, the inner and outer parts defining cooperating surfaces for sequentially opening and closing the inlet and outlet port means during the relative reciprocation of the parts whereupon the inner part traverses the inlet port means during the pumping cycle to permit product to enter the pump chamber and dispense it from the pump chamber;

air assist means for assuring the presence of a predetermined quantity of air in the pump chamber to assist in the dispensing of the product from the pump chamber through the outlet port means;

venting means provided by cooperating surfaces of the piston and cylinder for replacing product removed from the container interior into the pump chamber with air; and a port forming part of the inlet port means communicating with the container interior and wherein the piston is hollow and includes at least one port forming part of the inlet port means in the lateral walls thereof extending from the exterior to the interior of the piston, and during the suction stroke the piston port being adapted to communicate with the cylinder port in passing the product into the pump chamber and thereafter the product is adapted to pass directly into the pump chamber from the cylinder port.

34. A dispensing pump system for dispensing product from a container, comprising:

a cylinder defining an outer part;

a piston defining an inner part in the cylinder and defining a pump chamber therewith, and the piston and cylinder being relatively reciprocal through a compression stroke from an extended position to an inserted position and through a suction stroke from the inserted position to the extended position;

inlet port means in the cylinder for cooperating in communicating the container interior with the pump chamber during the suction stroke to permit product to enter into the pump chamber from the container interior by creating a negative pressure differential between the pump chamber relative to the container interior to cause product to be sucked into the pump chamber;

a separate outlet port means in one of the parts for the product to be dispensed under pressure from the pump chamber during the compression stroke, the inner and outer parts defining cooperating surfaces for sequentially opening and closing the inlet and outlet port means during the relative reciprocation of the parts whereupon the inner part traverses the inlet port means during the pumping cycle to permit product to enter the pump chamber and dispense it from the pump chamber;

the pump chamber includes a resilient means for acting to prevent piston hang-up in the cylinder during the pumping cycle, the resilient means including means for providing an air pocket in the pump chamber by creating a negative pressure differential between the pump chamber and the ambient during part of the suction stroke so that air is sucked into the pump chamber from the ambient, and which air pocket is adapted to be compressed for purposes of eliminating piston hang-up in the cylinder during the pressure stroke; and venting means provided by cooperating surfaces of the piston and cylinder for replacing product removed from the container interior into the pump chamber with air.

35. A dispensable product containing consumer package comprising:

a receptacle containing the product to be dispensed and including an outlet opening;

a closure extending across the outlet opening for sealing the product in the container;

a dispensing pump associated with the closure for dispensing the product from the container, the dispensing pump including a cylinder, a piston in the cylinder defining a pump chamber therewith, and the cylinder and piston being relatively reciprocal through a compression stroke from an extended position to an inserted position and through a suction stroke from the inserted position to the extended position, inlet port means for cooperating in communicating the container interior with the pump chamber during the suction stroke to permit product to enter into the pump chamber from the container interior primarily by creating a negative pressure differential between the pump chamber relative to the container interior to cause product to be sucked into the pump chamber, outlet port means for product to be dispensed under pressure from the pump chamber during the compression stroke, the dispensing pump including a passage network means defined by cooperating surfaces of the cylinder and piston for sequentially communicating the inlet port means with the pump chamber during the suction stroke and communicating the pump chamber with the outlet port means during the compression stroke without the necessity of external inlet and outlet valves;

a discharge orifice means coupled with the outlet port means for directing product to be dispensed in a predetermined dispensing pattern;

venting means for permitting air from the ambient to replace product removed from the container interior into the pump chamber thereby relieving negative pressure in the container interior incident to the transfer of product into the pump chamber.

36. The invention in accordance with claim 35, wherein the venting means communicates the container interior directly with the ambient during operation of the pump.

37. The invention in accordance with claim 35, wherein the cylinder and piston therein each have a vertically disposed axis.

38. The invention in accordance with claim 35, wherein the cylinder and piston therein each have a horizontally disposed axis.

39. The invention in accordance with claim 35, wherein the outlet port means is a discharge orifice mounted on the cylinder.

40. The invention in accordance with claim 35, wherein the outlet port means is a discharge orifice mounted on the piston.

41. The invention in accordance with claim 35, wherein the cylinder and piston therein each have a vertically disposed axis, a finger engaging button on the exterior of the piston for facilitating vertical reciprocation of the piston in the cylinder and consequently discharge of the product from the pump chamber out through the outlet port means.

42. The invention in accordance with claim 35, wherein the dispensing pump includes a trigger means coupled with the piston for actuating the piston and causing its reciprocation in the cylinder during the compression stroke and suction stroke.

43. The invention in accordance with claim 42, wherein the cylinder and piston therein have vertically disposed axes.

44. The invention in accordance with claim 42, wherein the cylinder and piston disposed therein have horizontally disposed axes.

45. The invention in accordance with claim 35, wherein cooperating passages are between the cylinder and piston to permit the product in the pump chamber to be directed out through the outlet port means during the compression stroke.

46. The invention in accordance with claim 35, wherein the venting means includes cooperating passages between the cylinder and piston to permit air to be directed from the outlet port means into the container interior.

47. The invention in accordance with claim 35, wherein the cylinder is composed of two parts with one cylinder part telescoped within the other.

48. The invention in accordance with claim 35, wherein sealing rings are on the piston and spaced from one another in a predetermined manner and in relation to the inlet port means and the outlet port means.

49. The invention in accordance with claim 35, wherein a dip tube forms part of the inlet port means for directing product from the container interior into the pump chamber.

50. The invention in accordance with claim 35, wherein during the suction stroke air is sucked through the outlet port means from the ambient into the pump chamber to purge product from the outlet port means thereby rendering the pump system self-cleaning during each pump cycle to prevent clogging of product in the outlet port means.

51. The invention in accordance with claim 35, wherein the vent means includes cooperating passages that permit air to be directed from the outlet port means into the container interior during the suction stroke and compression stroke.

52. The invention in accordance with claim 35, wherein the cylinder has a port forming part of the inlet port means communicating with the container interior and wherein the piston is hollow and includes at least one port forming part of the inlet port means in the lateral walls thereof extending the exterior to the interior of the piston, and during the suction stroke the piston port being adapted to communicate with the cylinder port in passing the product into the pump chamber and thereafter the product is adapted to pass directly into the pump chamber after the cylinder port.

53. The invention in accordance with claim 35, wherein the dispensing pump system includes a trigger means coupled with a piston for actuating the piston and causing its reciprocation in the cylinder during the compression stroke and suction stroke, the trigger means including a force multiplying means which provides a mechanical advantage thereby permitting the piston to adapt a short stroke for a relatively large given product delivery.

54. The invention in accordance with claim 53, wherein the force multiplying means includes a lever actuated linkage assembly for transforming movement of the trigger means into lateral movement of the piston.

55. The invention in accordance with claim 35, wherein the cylinder and piston therein each have a vertically disposed axis, a finger engaging button on the exterior of the piston for facilitating vertical reciprocation of the piston in the cylinder and consequently discharge of the product from the pump chamber out through the outlet port means, the outlet port means including a discharge orifice fixedly mounted in relation to the vertical reciprocation of the piston in the cylinder, and the outlet port means including a passage network from the pump chamber to the discharge orifice for passing product from the pump chamber to the discharge orifice during the compression stroke.

56. The invention in accordance with claim 35, wherein the pump chamber includes a resilient means for acting to prevent piston hang-up in the cylinder during the pumping cycle.

57. The invention in accordance with claim 56, wherein the resilient means includes means for providing an air pocket in the pump chamber which is adapted to be compressed for purposes of eliminating piston hang-up in the cylinder.

58. A dispensing pump system for dispensing product from a container comprising:

a cylinder;

a piston in the cylinder defining a pump chamber therewith, and the cylinder and piston being relatively reciprocal through a compression stroke from an extended position to an inserted position and through a suction stroke from the inserted position to the extended position;

inlet port means for cooperating in communicating the container interior with the pump chamber during the suction stroke to permit product to enter into the pump chamber from the container interior primarily by creating a negative pressure differential between the pump chamber relative to the container interior to cause product to be sucked into the pump chamber;

outlet port means for product to be dispensed under pressure from the pump chamber during the compression stroke;

a passage network means for sequentially communicating the inlet port means with the pump chamber during the suction stroke and communicating the pump chamber with the outlet port means during the compression stroke;

the passage network means and both port means being so constructed and arranged that during the compression stroke from an extended position to an inserted position, the piston initially seals off the inlet port means and the passage network means will then permit direct communication between the pump chamber and the outlet port means to pressurize the pump chamber and cause the product therein to travel through the passage network and outlet port means;

during the suction stroke from the inserted position to the extended position the piston seals off the outlet port and the passage network means permits communication between inlet port means and the pump chamber for product to be drawn from the container interior into the pump chamber;

and during the relative reciprocation of the piston and cylinder the passage network means operate to reduce negative pressure in the container as a result of the withdrawal of product therefrom into the pump chamber.

59. The invention in accordance with claim 58, wherein the passage network means is operable to directly communicate the outlet port means with the inlet port means during the suction stroke.

60. The invention in accordance with claim 59, wherein the passage network means is operable to cause direct communication between the outlet port means and the inlet port means during the compression stroke.

61. The invention in accordance with claim 58, wherein the passage network means is operable to cause direct communication between the outlet port means and the inlet port means.

62. The invention in accordance with claim 61, wherein the passage network means includes a longitudinal and lateral passageway through the piston.

63. The invention in accordance with claim 62, wherein the passage network means includes a channel in the internal walls of the cylinder that communicate with the lateral passageway of the piston whereby the lateral passageway, the channel and the outlet port means communicate with the pump chamber during the compression stroke to permit the product to be directed from the pump chamber to the outlet port means.

64. The invention in accordance with claim 63, wherein another longitudinal passageway and lateral passageway are provided in the piston and are in direct communication with the outlet port means and both of the lateral passageways are adapted to communicate with one another during the compression stroke when both lateral passageways are in communication with the channel in the cylinder.

65. The invention in accordance with claim 58, wherein during the initial stages of the compression stroke the pump chamber is in communication with the inlet port means to permit the container interior to be exposed to the pressure in the pump chamber.

66. A dispensing pump system for dispensing product from a container, comprising:

an outer part;

an inner part in the outer part defining a pump chamber therewith, and the parts being relatively reciprocal through a compression stroke from an extended position to an inserted position and through a suction stroke from the inserted position to the extended position;

inlet port means in the outer part for cooperating in communicating the container interior with the pump chamber during the suction stroke to permit product to enter into the pump chamber from the container interior primarily by creating a negative pressure differential between the pump chamber relative to the container interior to cause product to be sucked into the pump chamber, and the pump chamber being exposed to the ambient during the operation of the pump;

a separate outlet port means in one of the parts for product to be dispensed under pressure from the pump chamber during the compression stroke, the inner and outer parts defining cooperating surfaces for sequentially opening and closing the inlet and outlet port means during the relative reciprocation of the parts whereupon the inner part traverses the inlet port means during the pumping cycle to permit product to enter the pump chamber and dispense it from the pump chamber; and venting means provided by cooperating surfaces of the inner and outer part for replacing product removed from the container interior into the pump chamber with air.

67. A dispensing pump system for dispensing product from a container, comprising:

a cylinder having an open end and a closed end;

a piston in the cylinder having a forward end and a rear end and the piston forward end defining with the cylinder closed end a pump chamber, the piston and cylinder being relatively reciprocal through a compression stroke from an extended position to an inserted position and through a suction stroke from the inserted position to the extended position;

inlet port means for cooperating in communicating the container interior with the pump chamber during the suction stroke to permit product to enter into the pump chamber from the container interior by creating a negative pressure differential between the pump chamber relative to the container interior to cause product to be sucked into the pump chamber;

outlet port means for product to be dispensed under pressure from the pump chamber during the compression stroke, the outlet port means being spaced from the inlet port means in an axial direction and being further away from the cylinder closed end than the inlet port means;

the piston having at least three spaced sealing rings, a first ring closer to the rear end for sealing the juncture between the piston and cylinder when the piston and cylinder are in the extended position and the product to be dispensed is in the pump chamber and being interposed between the outlet port means and the open end of the cylinder when the piston and cylinder are in the inserted position, a third ring closer to the forward end of the cylinder for opening and closing the inlet port means from the pump chamber and when the piston and cylinder are in the extended position the third ring is interposed between the inlet port means and the outlet port means, and a second ring intermediate the first and third ring, the piston having a longitudinal passage and a transverse passage, the transverse passage and the third ring are so positioned relative to one another that when the inlet port means is sealed by the third ring the relative reciprocation of the piston and cylinder is assured so that eventually the outlet port means will communicate with the pump chamber to prevent liquid lock of the piston in the cylinder and to permit operation of the pump.

68. The invention in accordance with claim 67, wherein the transverse passage is between the first and second ring and communicates directly with the longitudinal passage and a stationary outlet orifice forms part of the outlet port means.

69. The invention in accordance with claim 68, wherein the first and third rings are spaced apart a distance exceeding the distance between the inlet and outlet port means and inlet port means communicating with the outlet port means to vent the container when the third ring is interposed between the inlet port means and the closed end of the cylinder and the first ring is on the side of the outlet port means closest the open cylinder end.

70. The invention in accordance with claim 69, wherein the second ring is spaced from the third ring by less than the maximum distance between the forward end of the inlet port means and the rear end of the outlet port means.

71. The invention in accordance with claim 70, wherein the transverse passage is interposed between the first and second ring.

72. The invention in accordance with claim 71 wherein, a fourth ring is interposed between the first and second ring for cooperating in defining the duration that the product passes out of the pump chamber into the outlet port means, and the transverse passage is interposed between the first and fourth rings.

73. The invention in accordance with claim 67, wherein the cylinder includes a channel forming part of the outlet port means between the inlet port means and the open end of the cylinder, and the transverse passage being between the first and second rings, a second transverse passage communicating directly with the longitudinal passage, a partition across the piston between the transverse passages, a movable outlet orifice forming part of the outlet port means and movable with the piston, the partition serving as a barrier preventing direct communication between the longitudinal passage and the outlet orifice, and when the second ring traverses the channel during reciprocation of the piston, the longitudinal passage is adapted to communicate with the outlet orifice through the transverse passages and the channel.

74. The invention in accordance with claim 73, wherein the first and third rings are spaced apart to a distance exceeding the distance between the inlet and outlet port means and the inlet port means communicates with the outlet port means to vent the container when the third ring is interposed between the inlet port means and the closed end of the cylinder and the first ring is at the side of the channel closest the open cylinder end and the second ring traverses the channel to permit communication between the outlet orifice, second traverse passage, the channel, the clearance between the piston and cylinder between the second and third rings and the inlet port means.

75. The invention in accordance with claim 74, wherein the second ring is spaced from the third ring by at least the distance between the forward end of the inlet port means and the rear end of the outlet channel.

76. The invention in accordance with claim 75, wherein a fourth ring is interposed between the second and third ring for isolating the channel and the inlet port means during the compression stroke and cooperating in assuring that the passage of product out of the pump chamber through the longitudinal passage, the transverse passages and interconnecting channel out through the outlet orifice.

77. The invention in accordance with claim 67, wherein the piston and rings are integrally constructed, and a tubular resilient sleeve covering the rings.

78. The invention in accordance with claim 67, wherein the piston comprises two piston parts with one piston part being a ring sleeve which is fitted over the other piston part, the sleeve having the rings thereon as integral outwardly and circumferentially extending projections.

79. The invention in accordance with claim 78 wherein the sleeve is molded and is of tubular configuration fitted over the forward end of the piston with the transverse passage extending through the sleeve, each said ring having a base and tapering to an outer feather edge, each ring having a forward and a rear face, the forward face being inclined forwardly defining an acute angle with the axis of the piston so that the rings resist any tendency to collapse during the compression stroke.

80. The invention in accordance with claim 79 wherein the rear face of each ring is arcuate.

81. The invention in accordance with claim 67 wherein venting means are provided for replacing product removed from the container interior into the pump chamber with air.

82. The invention in accordance with claim 81 wherein the venting means provides direct communication between the ambient and the container interior during reciprocation of the piston.

83. The invention in accordance with claim 67, wherein the pump chamber is sealed from the outlet port means when the piston and cylinder are in the extended position.

* * * * *